United States Patent [19]

Russel

[11] Patent Number: 4,699,367

[45] Date of Patent: Oct. 13, 1987

[54] SHEET TURNOVER MECHANISM

[75] Inventor: Matthew J. Russel, Rochester, N.Y.

[73] Assignee: Eastman Kodak Company, Rochester, N.Y.

[21] Appl. No.: 831,960

[22] Filed: Feb. 24, 1986

[51] Int. Cl.[4] ..... B65H 29/60

[52] U.S. Cl. ..... 271/65; 271/186; 271/274; 271/902

[58] Field of Search ..... 271/65, 184, 185, 186, 271/902, 225, 291

[56] References Cited

U.S. PATENT DOCUMENTS

| | | | |
|---|---|---|---|
| 3,337,213 | 8/1967 | La Barre | 271/3 |
| 3,671,719 | 6/1972 | May | 271/36 |
| 3,856,295 | 12/1974 | Looney | 271/65 |
| 3,942,785 | 3/1976 | Stange | 271/902 X |
| 3,948,505 | 4/1976 | Miller et al. | 271/902 X |
| 4,214,740 | 7/1980 | Acquaviva | 271/902 X |
| 4,346,880 | 8/1982 | Roller et al. | 271/186 |
| 4,488,801 | 12/1984 | Gibson | 355/35 H |

FOREIGN PATENT DOCUMENTS

| | | | |
|---|---|---|---|
| 0128155 | 7/1984 | Japan | 271/65 |

OTHER PUBLICATIONS

IBM Tech. Disc. Bulletin, vol. 18 (#1), Jun. 75, p. 40, Harding.

IBM Tech. Disc. Bulletin, vol. 19 (#12), May 77, p. 4496, Bullock.

*Primary Examiner*—Joseph J. Rolla

*Assistant Examiner*—Frederick R. Handren

*Attorney, Agent, or Firm*—Lawrence P. Kessler

[57] ABSTRACT

A mechanism for use with a sheet transport apparatus for turning over a sheet transported along a travel path, such mechanism reliably functioning irrespective of sheet weight or size. With the mechanism, a sheet is selectively moved in one direction from a travel path or in an opposite direction into such travel path. The surface of the moving sheet is engaged so that energy derived by the sheet being transported in the direction from the travel path is stored. When the sheet is no longer being transported in such direction, the stored energy is utilized to move the sheet in the opposite direction to a point where it can be transported in such opposite direction back into the travel path with its trail edge becoming the lead edge and its surface orientation reversed.

4 Claims, 6 Drawing Figures

SHEET TURNOVER MECHANISM

BACKGROUND OF THE INVENTION

This invention relates in general to sheet transport apparatus, and more particularly to a mechanism for use with a sheet transport apparatus for turning over a sheet transported along a travel path.

In transporting sheets along a travel path, it is sometimes required that the sheet be turned over so that the leading edge becomes the trailing edge and its surface orientation is reversed. One typical mechanism for accomplishing such sheet turnover includes a three-roller cluster located in association with the sheet travel path; see for example U.S. Pat. No. 3,856,295 (issued Dec. 24, 1974 in the name of Looney). In such mechanism, the transported sheet is directed into the nip between a first roller and the middle roller of a three-roller cluster and is fed therethrough into a curved chamber until the trailing edge clears such nip. The leading edge of the sheet is directed against a resilient stop which causes the sheet to reverse its direction of travel. Due to the curvature of the chamber and the beam strength of the sheet, the sheet traveling in the reverse direction is directed into the nip between the middle roller and the third roller of the cluster. The sheet is thereby transported back into the travel path with the trailing edge becoming the leading edge and its surface orientation being reversed.

While the use of a resilient stop is generally effective in cooperation with a three-roller cluster for turning over a sheet, it is subject to certain limitations. The resilient stop must have its spring characteristics tailored to the characteristics of the sheet being turned over. That is to say, the stop must have sufficient resilience to assure that the sheet will receive enough impetus to return to the appropriate nip of the three-roller cluster, but must not damage the edge of the sheet as it imparts such impetus. If a variety of weights of sheets must be handled, a resilient stop selected to ensure reversal of movement of a heavy weight sheet may damage the engaged edge of a lighter weight sheet; and a resilient stop selected to prevent damage to a light weight sheet may not provide sufficient impetus to a heavier weight sheet. Further, the resilient stop must be located a distance from the three-roller cluster to ensure that the trail edge of the sheet clears the cluster, that the inertia of the sheet imparted by the cluster will be sufficient to enable this sheet to reach the stop, and that the return impetus is sufficient for the sheet to be returned into the appropriate nip of the cluster. Therefore, the resilient stop must be adjustably located so as to accommodate a variety of sheet sizes (measured in the direction of the travel path) or, if not adjustably located, must be utilized with only a narrow range of sheet sizes.

SUMMARY OF THE INVENTION

This invention is directed to a mechanism for use with a sheet transport apparatus for turning over a sheet transported along a travel path, such mechanism reliably functioning irrespective of sheet weight or size. With the mechanism, a sheet is selectively moved in one direction from a travel path or in an opposite direction into such travel path. The surface of the moving sheet is engaged so that energy derived by the sheet being transported in the direction from the travel path is stored. When the sheet is no longer being transported in such direction, the stored energy is utilized to move the sheet in the opposite direction to a point where it can be transported in such one direction, the stored energy is utilized to move the sheet in the opposite direction to a point where it can be transported in such opposite direction back into the travel path with its trail edge becoming the lead edge and its surface orientation reversed.

With the mechanism according to this invention, sheets of various weights and sizes may be turned over with any adjustments to the mechanism being required. Engagement of the sheet surface during turnover, as opposed to edge engagement as found in the prior art, avoids potential damage to a sheet edge. Further, such surface engagement eliminates the requirement to adjust the location of the turnover mechanism to effect turnover of different size sheets.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
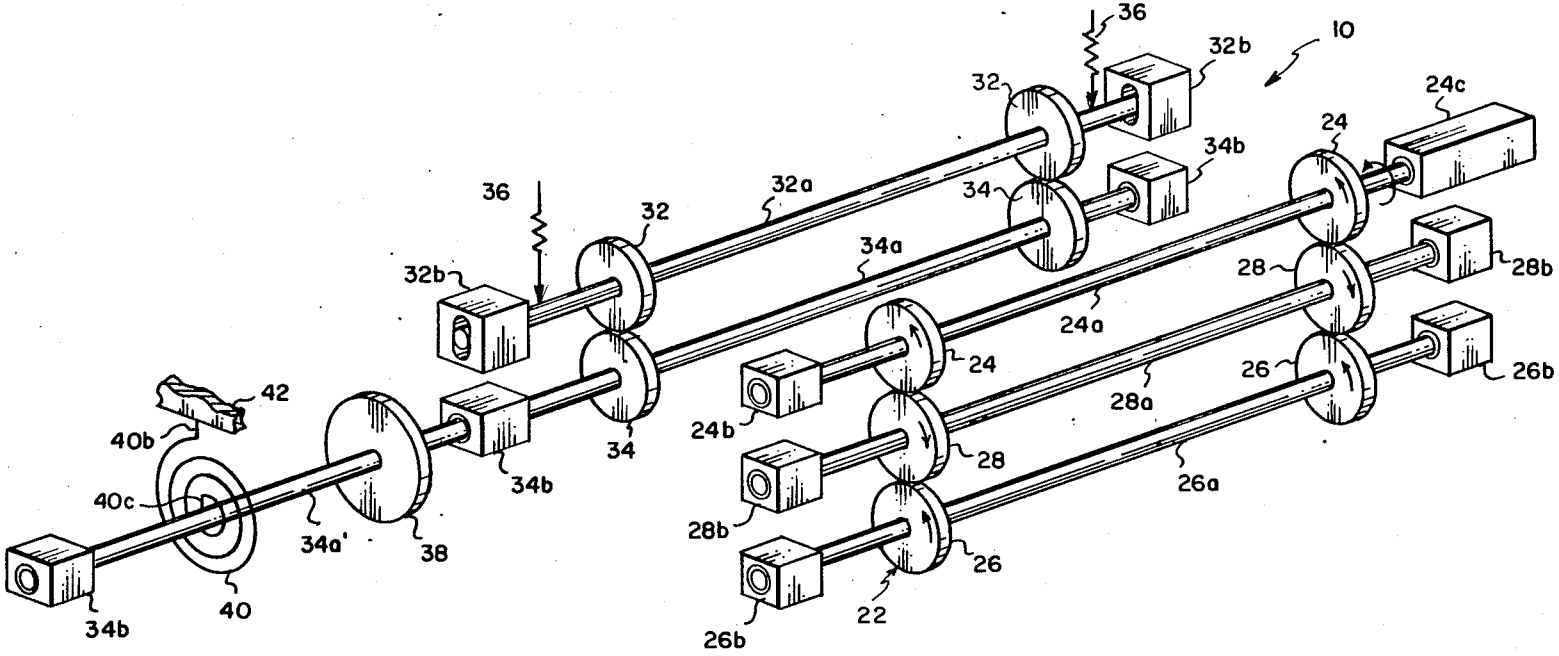
FIG. 1 is a view, in perspective, of the mechanism for turning over a sheet moving along a travel path according to this invention, with portions removed to facilitate viewing.
Figure 2:
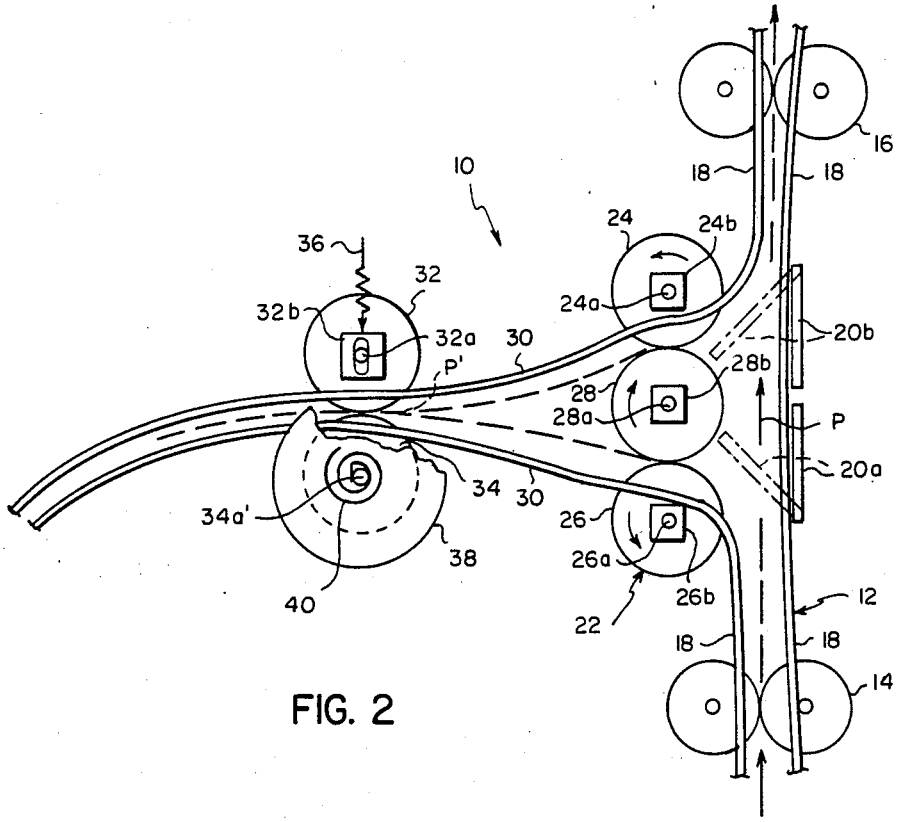
FIG. 2 is a side elevational view of the mechanism of FIG. 1, with portions broken away or removed to facilitate viewing.

Referring now to the accompanying drawings, FIGS. 1 and 2 show a mechanism, designated generally by the numeral 10, for turning over a sheet according to this invention. The mechanism 10 is associated with an apparatus 12 for transporting sheets seriatim along a travel path P. The transport apparatus 12 includes, for example, spaced pairs of nip drive rollers 14, 16 for urging a sheet along the travel path described by wire-form guides 18.

The mechanism 10 comprises a pair of diverters **20*a*, 20*b* located in juxtaposition with the sheet travel path P. The diverters are pivotally mounted for movement between a first position (solid line position of FIG. 2) out of the path and a second position (phantom line position of FIG. 2) intercepting the path P. In their respective intercepting positions, the diverter 20*a* directs a sheet out of the travel path into a three-roller cluster 22 and diverter 20*b*** directs a sheet out of the three-roller cluster into the travel path.

The cluster 22 includes a plurality of sets of outboard rollers 24 and 26 in nip relation with a plurality of cooperating rollers 28 respectively. The rollers 24 are mounted on a common shaft **24*a*, rollers 26 are mounted on a common shaft 26*a*, and rollers 28 are mounted on a common shaft 28*a*. The shafts 26*a* and 28*a* are respectively supported for free rotation in bearings 26*b* and 28*b*, while the shaft 24*a* is supported at one end in a bearing 24*b* and coupled at the other end to a motor 24*c* to be rotatably driven by such motor. Accordingly, when the motor 24*c* rotates the shaft 24*a* in a counterclockwise direction, the rollers of the cluster 22 rotate in the respective directions indicated by their associated arrows. By such rotations, a sheet directed by diverter 20***a* from the path P into the nip between rollers 26 and 28 is transported away from the path P; and a sheet in the nip between rollers 26 and 24 is transported in a direction which, in cooperation with diverter 20*b*, returns the sheet to the path P. A sheet transported away from the path P is confined within a path P′ described by wire-form guides 30 (see FIG. 2) for example.

The mechanism 10 further comprises a plurality of sets of passive nip rollers 32, 34 located in association with the path P′ adjacent to the cluster 22 on the opposite side thereof from the path P. The rollers 32 are mounted on a common shaft 32*a*, and the rollers 34 are mounted on a common shaft 34*a*. The shafts 32*a* and 34*a* are respectively supported for free rotation in bearings 32*b* and 34*b*, and shaft 32*a* is urged toward shaft 34*a* by springs 36. The springs 36 are selected to have a spring constant sufficient to provide effective frictional engagement between the rollers 32, 34 and a sheet located therebetween, while enabling the rollers to move apart to accommodate a wide variety of sheet weights (thicknesses). The shaft 34*a* has an extension 34*a*′ upon which a flywheel 38 is mounted. Additionally, a clock spring 40 is connected at one end 40*c* to the shaft extension 34*a*′ and at the opposite end 40*b* to a fixed reference plane 42.

While the cluster 22 and passive nip rollers 32, 34 have been respectively shown and described as including a plurality of roller sets, they could each comprise a single roller set located on their respective shafts in a substantially vertical plane passing through the center line of the sheet travel path in the mechanism 10.

Figure 3:
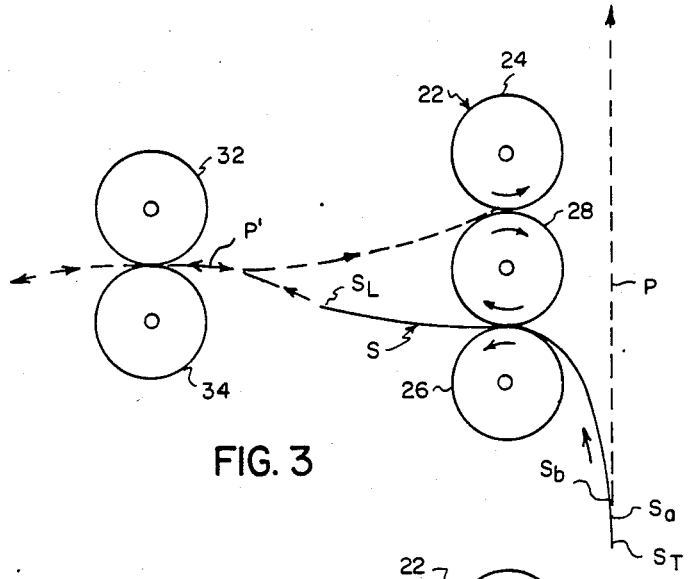
Figure 4:
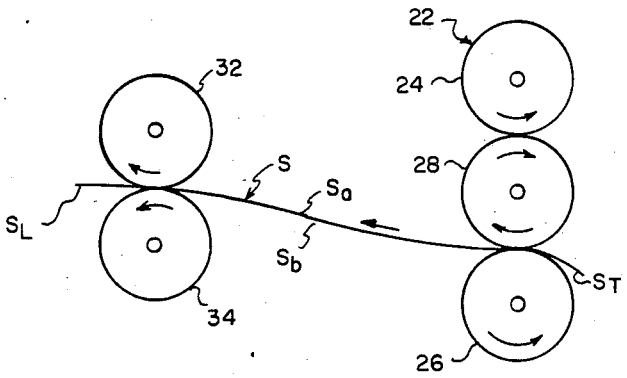

With the above described construction, the mechanism 10 of this invention operates to turn a sheet over in the manner described hereinbelow with particular reference to FIGS. 3–6. A sheet S traveling in the path P in the direction of its associated arrow has a lead edge $S_L$, a trail edge $S_T$ and opposing surfaces $S_a$ and $S_b$. The lead edge $S_L$ is directed (by diverter 20*a*) into the nip between rollers 26 and 28 of the three-roller cluster 22 which transports the sheet along path P′ toward the passive nip rollers 32, 34 as shown in FIG. 3. The spacing between the cluster 22 and the passive nip rollers 32, 34 is selected so that, irrespective of the length of a transported sheet (i.e., the distance measured between lead edge $S_L$ and trail edge $S_T$), the sheet will enter the passive nip rollers while being transported by the cluster. When the sheet S under the influence of the cluster 22, enters the passive nip rollers 32, 34, the engagement of the moving sheet surfaces with the nip rollers cause the nip rollers to rotate in the direction of the associated arrows as shown in FIG. 4. Rotation of the passive nip rollers causes the shaft 34*a* (and extension 34*a*′) to rotate which, in turn, rotates the flywheel 38 and winds up the clock spring 40. The clock spring 40 thus serves to store energy resulting from the positive drive of the sheet through the passive nip rollers by the three-roller cluster.

Figure 6:
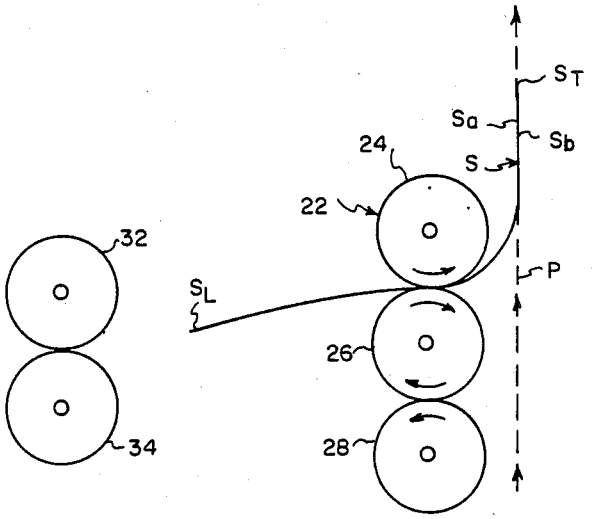
FIG. 3 through 6 are schematic side elevational views of the mechanism of FIG. 1 respectively taken at various times during the operation of such mechanism.
Figure 5:
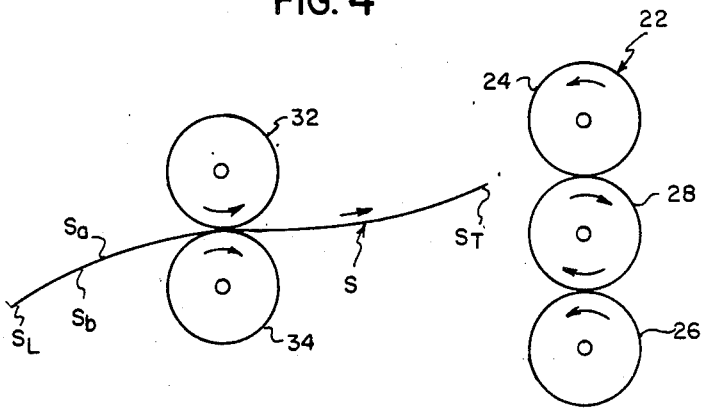

When the trail edge $S_T$ of the sheet S leaves the nip between the rollers 26, 28 of the cluster 22, the sheet is of course no longer being positively driven thereby. However, the inertia of the fly wheel 38 causes the shaft extention 34*a*′ (and thus shaft 34*a*) to continue rotating the passive nip rollers 32, 34 for a sufficient time to ensure that the trail edge has fully cleared the cluster 22. The inertia of the flywheel continues to rotate the shaft extension 34*a*′ until it is overcome by the force of the clock spring 40 on the shaft extension. At the time the inertia of the flywheel 38 is overcome by the clock spring, the energy stored by the clock spring is effective to reverse rotation of the shaft extension 34*a*′ (and thus shaft 34*a*). The rotation of the shaft 34*a*′, due to the energy stored in the clock spring, causes the passive nip rollers 32, 34 to rotate in the direction of their associated arrows as shown in FIG. 5. Such rotation of the passive nip rollers is effective on the surfaces of the sheet S to transport the sheet along path P′ in the direction of its associated arrow into the nip between rollers 24 and 26 of the cluster 22 with the lead edge $S_L$ becoming the trail edge. The cluster 22 then transports the sheet S back into the path P for movement in the direction of its associated arrow as shown in FIG. 6. The sheet S is thus turned over with its lead edge $S_L$ becoming its trail edge, its trail edge $S_T$ becoming its lead ledge, and with the orientation of its surfaces $S_a$ and $S_b$ being reversed when compared to their orientation prior to entering the mechanism 10. The sheet S is thereafter transported along path P by the apparatus 12 in this desired turned over orientation.

The invention has been described in detail with particular reference to the preferred embodiment thereof, but it will be understood that variations and modifications can be effected within the spirit and scope of the invention.

I claim:

1. A mechanism for use with a sheet transport apparatus for turning over a sheet transported along a travel path by such apparatus, said mechanism comprising:

means, located in operative relation with said travel path, for selectively moving a sheet in one direction from said travel path or in an opposite direction into said travel path;

a pair of passive rollers constantly urged into nip relation, such nip being located to receive a sheet moved by said moving means therebetween and engage the surface of such sheet; and means, operatively associated with one of said pair of rollers and responsive to a sheet moving in sid one direction under the influence of said moving means for storing energy imparted to said one roller by the surface of such moving sheet, and responsive to such sheet leaving the influence of said moving means for delivering such stored energy to said one roller and thus to the surface of such sheet to move such sheet in said opposite direction back under the influence of said moving means in said opposite direction for return to said travel path with the trail edge of such sheet when moving in one direction becoming the lead edge when moving in said opposite direction and its surface orientation being reversed.

2. The invention of claim 1 further including means for resiliently urging said pair of passive rollers into such nip relation whereby different sheet weights can be accommodated in such nip.

3. The invention of claim 1 wherein said energy storing and delivery means includes a clock spring coupled to one of said passive rollers, said clock spring being wound up when a sheet moving in said one direction under the influence of the moving means travels through the nip between said pair of passive rollers rotates said one roller in one direction, and unwinding to rotate said one roller in the opposite direction to move said sheet in the nip between said pair of passive rollers in said opposite direction.

4. The invention of claim 3 wherein said moving means is a three-roller cluster in which one of the rollers of such cluster cooperates with a second roller to move a sheet in said one direction and the third roller of such cluster cooperates with said second roller to move a sheet in said opposite direction.

* * * * *